United States Patent [19]

Nishikawa

[11] 4,354,454

[45] Oct. 19, 1982

[54] DEVELOPING DEVICE WITH MAGNETIC POLE HAVING MAGNETIC SPACER MEMBERS

[75] Inventor: Masaji Nishikawa, Hachioji, Japan

[73] Assignee: Olympus Optical Company Limited, Tokyo, Japan

[21] Appl. No.: 209,294

[22] Filed: Nov. 21, 1980

[30] Foreign Application Priority Data

Dec. 8, 1979 [JP] Japan ..... 54/158712

[51] Int. Cl.[3] ..... G03G 15/09

[52] U.S. Cl. ..... 118/658; 355/3 DD

[58] Field of Search ..... 361/212, 221; 118/657, 118/658; 427/25, 47; 428/922; 209/904; 355/3 DD

[56] References Cited

U.S. PATENT DOCUMENTS

| | | | |
|---|---|---|---|
| 3,402,698 | 9/1968 | Kojima et al. | 118/658 |
| 3,703,395 | 11/1972 | Drexler et al. | 427/47 |
| 3,939,801 | 2/1976 | Tanaka | 118/658 |
| 4,171,900 | 10/1979 | Brugger et al. | 118/658 X |
| 4,273,800 | 6/1981 | Reid | 427/47 |

*Primary Examiner*—John D. Smith
*Assistant Examiner*—Thurman K. Page
*Attorney, Agent, or Firm*—Fleit & Jacobson

[57] ABSTRACT

A magnetic roll developing device comprising a magnet for forming a developing main magnetic pole and divided into a plurality of magnet portions so as to form spaces therebetween and spacer members fitted in said spaces and forming weak magnets, the plurality of magnet portions forming a plurality of independent brush fur-like portions of the developing agent.

9 Claims, 16 Drawing Figures

DEVELOPING DEVICE WITH MAGNETIC POLE HAVING MAGNETIC SPACER MEMBERS

BACKGROUND OF THE INVENTION

1. Field of the Invention

This invention relates to a magnet roll developing device provided with a non-magnetic rotary sleeve and operative to hold and transfer a magnetic developing agent such as a magnetic two component developing agent composed of a mixture of a magnetic powder carrier and toner, magnetic two component toner developing agent composed of toner containing magnetic powders and frictional charging powders, magnetic one component developing agent composed of toner containing magnetic powders or the like and operative to form a brush fur-shaped portion of the developing agent which acts upon a surface to be developed.

2. Description of the Prior Art

The above mentioned kind of magnet roll developing device has widely been used in an electrophotographic apparatus, electrostatic printer or the like. Such magnet roll developing device, however, has the disadvantage that the electrostatic latent image produced on the surface to be developed, particularly the imagewise dark portion having a large area could not be developed with a sufficiently large concentration and that the developing ability is not always excellent.

In such conventional magnet roll developing device, in order to improve the developing ability, it has been proposed to increase the rotary speed of the non-magnetic rotary sleeve so as to increase the amount of developing agent in contact with unit area of the surface to be developed. But, if the non-magnetic rotary sleeve is rotated at a high speed, much amount of the toner and carrier is scattered. As a result, such conventional developing device has the disadvantage that the developing device and surrounding portions thereof are contaminated, that the non-picture image portion of the surface to be developed becomes overdeveloped, and that the developed picture image becomes uneven in concentration in correspondence with the moving direction of developing agent.

Another conventional developing device in which the developing main magnetic pole is divided into two small magnetic poles which are the same in polarity so as to improve the developing ability has also be proposed. In such conventional developing device, the magnetic lines of force produced from the magnet roll take a configuration which can form two brush fur-like portions thereof. But, if the magnetic developing agent is aligned with the magnetic lines of force, the difference between the density of the magnetic lines of force at the divided two magnetic poles and that in the space between those magnetic poles is not so large that the brush fur-like portions of the developing agent tend to be easily formed in the space. As a result, the brush fur-like portions of the developing agent formed by the two magnetic poles become similar to the brush fur-like portion of the developing agent formed by a single magnetic pole and having a density which is low at the center of the single magnetic pole. Such conventional developing device, therefor, does not contribute to improvement in the developing ability.

In the magnet roll developing device, it is preferable to divide the brush fur-like portion of developing agent at the developing main magnetic pole into a number of brush fur-like portions and to cause these brush fur-shaped portions thus obtained to evenly act upon the surface to be developed for the purpose of developing a picture image having a high revolving power.

But, in the conventional magnet roll developing device, the number of the brush fur-like portions of the developing agent formed by the developing main magnetic pole is minutely changed owing to the distance between a doctor blade and the non-magnetic rotary sleeve, magnetic flux density at the developing main magnetic pole, diameter of the developing agent particles or the like within a limited range. It is impossible to considerably increase the number of brush fur-like portions of the developing agent having a suitable strength. As a result, such conventional developing device has the disadvantage that the picture image having an excellent resolving power can only be developed within a limited range.

SUMMARY OF THE INVENTION

An object of the invention, therefore, is to provide a magnet roll developing device which can eliminate the above mentioned drawbacks which have been encountered with the prior art techniques, which can make the concentration of the picture image high without overdeveloping the non-picture image portion, which can effectively prevent uneven development induced due to the moving direction of the magnetic developing agent and which can effectively develop the picture image having an extremely high resolving power.

A feature of the invention is the provision in a magnet roll developing device comprising a magnet roll including a developing main magnetic pole opposed to a surface to be developed and a plurality of transfer magnetic poles and made stationary with respect to the surface to be developed, a non-magnetic rotary sleeve rotatably mounted around the outer peripheral surface of the magnetic roll and a doctor blade for controlling a thickness of a developing agent layer held on the non-magnetic rotary sleeve, of the improvement in which a magnet for forming the developing main magnetic pole opposed to the surface to be developed is divided into a plurality of magnet portions distant apart from each other by spaces into which are arranged spacing members 3 each composed of a magnetic body or a magnet having a weak magnetic force in a direction such that surface of said weak magnet which is opposite in polarity to said developing main magnetic pole is exposed, whereby one portion of the magnetic lines of force starting from the magnet surface for forming the developing main magnetic pole is directed toward said spacing member and a space in which magnetic lines of force are low in density is formed near said spacing member, the thickness of the developing agent layer held on said non-magnetic rotary sleeve being suitably adjusted to form a plurality of independent brush fur-like portions of the developing agent corresponding to each magnetic pole of the divided magnets for the developing main magnetic pole.

Further objects and features of the invention will be fully understood from the following detailed description with reference to the accompanying drawings, wherein:

DETAILED DESCRIPTION OF THE PREFERRED EMBODIMENTS

Figure 1:
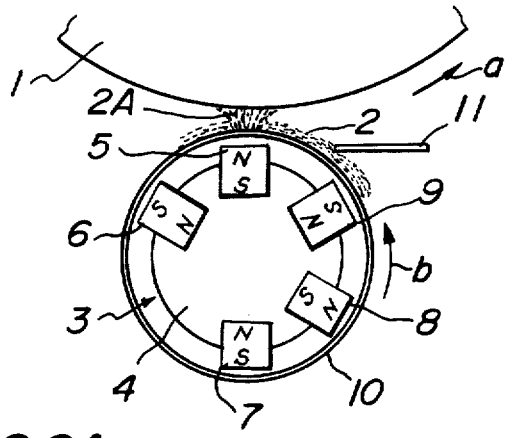
FIG. 1 PRIOR ART
FIG. 1 is a diagrammatic view of one example of a conventional magnet roll developing device.

Referring to FIG. 1, reference numeral 1 designates a surface to be developed of a conventional magnet roll developing device comprising a magnet roll 3. If the surface to be developed 1 is rotated in a direction shown by an arrow a, a magnetic two component developing agent 2 is brought into contact with the surface to be developed 1. The surface to be developed 1 is composed of a photosensitive drum or the like and functions to hold an electrostatic latent image produced thereon in a conventional electrophotographic manner. As a result, it is possible to develop the electrostatic latent image by toner of the developing agent 2. The magnet roll 3 is spaced apart from the surface to be developed 1 by a given distance and made stationary. The magnet roll 3 is composed of a roll-shaped supporting member 4 provided along its periphery with a developing main magnet 5 and transfer magnets 6, 7, 8 and 9. The developing main magnet 5 functions to produce a magnetic force which can not only form a brush fur-like portion 2A of the developing agent directed toward the surface to be developed 1 but also hold and transfer the developing agent 2. The transfer magnets 6, 7, 8 and 9 function to produce a magnetic force which can hold and transfer the developing agent 2. A non-magnetic rotary sleeve 10 formed of aluminum or the like is rotatably mounted around the outer periphery of the magnet roll 3 and is rotated in a direction shown by an arrow b by means of a driving means not shown. The magnetic two component developing agent 2 is subjected to the action of the magnetic force in a direction of the magnetic lines of force penetrated through the non-magnetic rotary sleeve 10. The action of the magnetic force causes the magnetic two component developing agent 2 to be held on the non-magnetic rotary sleeve 10 and to be formed into the brush fur-like portion directed toward the surface to be developed 1 at the developing main magnetic pole 5.

If the non-magnet rotary sleeve 10 is rotated in a direction shown by an arrow b, the magnetic two component developing agent 2 held thereon is also moved in the direction shown by the arrow b and reaches to a doctor blade 11 arranged between the transfer magnet 9 and the developing main magnet 5. The doctor blade 11 functions to rake off the surplus developing agent so as to obtain a given thickness of the magnetic two-component developing agent 2. The developing agent 2 arrives at the developing main magnet 5 and is deformed into the brush fur-like portion 2A directed toward the surface to be developed 1. The brush fur-like portion 2A makes contact with the surface to be developed 1 and is moved there along to develop the electrostatic latent image produced on the surface to be developed 1.

At one portion of the magnet roll 3, the distance between two magnets is made larger than that between the other magnets or the two magnets are made the same in polarity such that the developing agent which has completed its developing action is dropped down from this portion of the magnetic roll 3 by its gravity or scraped from the non-magnetic rotary sleeve 10 by means of a scraper not shown.

The developing agent removed from the non-magnetic rotary sleeve 10 is supplied with toner or evenly mixed therewith and held again on the non-magnetic rotary sleeve 10, thereby repeating the above mentioned steps.

Figure 2A:
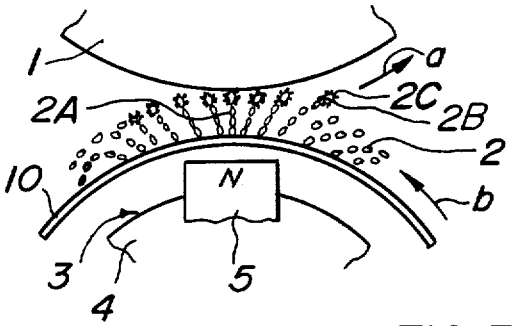
FIGS. 2A and 2B are diagrammatic views illustrating the developing action of the conventional developing device shown in FIG. 1.
Figure 2B:
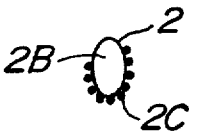

The developing action of the conventional magnet roll developing device shown in FIG. 1 will be described in detail with reference to FIGS. 2A and 2B. As shown in FIG. 2A, if the non-magnetic rotary sleeve 10 is rotated in a direction shown by an arrow b, at that portion of the non-magnetic rotary sleeve 10 which is adjacent to the developing main magnet 5, a number of developing agent particles are gathered along the magnetic lines of force to form a brush fur-like portion of the developing agent particles directed toward the surface to be developed 1. If the front end of the brush fur-like portion of the developing agent particles reach to the surface to be developed 1, the electrostatic latent image functions to attract the toner and the front end of the brush fur-like portion of the developing agent particles are disturbed by the surface to be developed 1. As a result, the brush fur-like portion of the developing agent particles pass through the developing main magnet 5 whilst deforming the brush fur-like portion such that the length of the brush fur-like portion as a whole becomes shortened in succession. At the center portion of the magnetic pole of the developing main magnet 5, the distance between the surface to be developed 1 and the non-magnetic rotary sleeve 10 becomes the shortest and the brush fur-like portion 2A is directed vertically from the sleeve surface 10 toward the surface to be developed 1, so that the length of the brush fur-like portion 2A becomes the shortest. If the brush fur-like portions 2A pass through the center portion of the developing main magnet 5, the length of the brush fur-like portions A becomes somewhat longer and the distance between the surface to be developed 1 and the non-magnetic rotary sleeve 10 becomes longer, so that the front end of the brush fur-like portion 2A is separated from the surface to be developed 1.

In the course of such movement of the developing agent 2, the front end of the brush fur-like portion 2A always makes contact with the surface to be developed 1 and the movement of the front end of the brush fur-like portion 2A of the developing agent is extremely small. As a result, in the magnetic two component developing agent 2 formed of a mixture of the magnetic carrier powders and the toner, very small amount of the toner 2C adhered to the overall periphery of the carrier 2B of the brush fur-like portions 2A which is located at the side of the surface to be developed 1 only contribute to the developing action. In the developing agent of the brush fur-like portions 2A which has completed its developing action, that portion of the carrier 2B which is adjacent to the surface to be developed 1 only loses its toner as shown in FIG. 2B. As a result, the electrostatic latent image produced on the surface to be developed 1, particularly the imagewise dark portion having a large area can not be developed with a sufficiently large concentration and the developing ability is not always excellent.

In such conventional magnet roll developing device, as means for improving the developing ability, it has been proposed to increase the rotary speed of the non-magnetic rotary sleeve 10 so as to increase the amount of developing agent 2 in contact with unit area of the surface to be developed 1. But, if the non-magnetic rotary sleeve 10 is rotated at a high speed, much amount of the toner and carrier is scattered at that portion of the developing agent 2 which forms the brush fur-like portion. As a result, such conventional developing device has the disadvantage that the developing device and surrounding portions thereof are contaminated, that the non-picture image portion on the surface to be developed 1 becomes overdeveloped, and that the developed picture image becomes uneven in concentration in correspondence with the moving direction of the developing agent 2.

Figure 3:
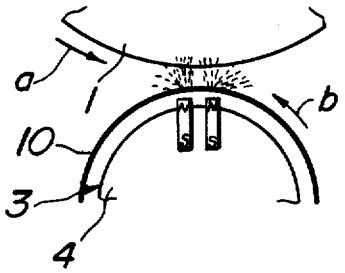
FIG. 3 is a diagrammatic view of essential parts of another example of a conventional magnet roll developing device.

Another conventional developing device in which the developing main magnetic pole of the magnet roll 3 is divided into two magnetic poles $N_1$, $N_2$ which are the same in polarity as shown in FIG. 3 so as to improve the developing ability has also been proposed. Such conventional developing device can increase the width of the brush fur-like portion of the developing agent formed on the non-magnetic rotary sleeve 10 at the magnetic poles $N_1$, $N_2$ to cause the developing agent to make contact with the surface to be developed 1 for a long time. But, similar to the conventional developing device shown in FIG. 1, the same part of the brush fur-like portion of the developing agent makes contact with the surface to be developed 1 for a long time. In addition, the amount of developing agent to be supplied is not increased unless the moving speed of the developing agent is made high. That is, the magnetic lines of force produced from the magnet roll 3 take configuration which can form two brush fur-like portions as shown by dotted lines in FIG. 3. But, if the magnetic developing agent is aligned with the magnetic lines of force, the difference between the density of the magnetic lines of force at the magnetic poles $N_1$, $N_2$ and that in the space between those magnetic poles is not so large that the brush fur-like portion of the developing agent tends to be easily formed in the space between the magnetic poles $N_1$, $N_2$.

Particularly, when the surface to be developed 1 is arranged such that the front end of the brush fur-like portion of the developing agent is deformed by the surface to be developed 1, the brush fur-like portion of the developing agent is positively formed at the space between the magnetic poles $N_1$, $N_2$. As a result, if the non-magnetic rotary sleeve 10 is rotated in a direction shown by an arrow b, the brush fur-like portion formed by the first magnetic pole $N_1$ and maintaining the magnetic lines of force is moved into the magnetic field produced by the second magnetic field $N_2$. The brush fur-like portion of the developing agent formed by the first magnetic pole $N_1$ is moved to the space formed between the magnetic poles $N_1$, $N_2$ where the brush fur-like portion of the developing agent having a low density is formed. As a result, the brush fur-like portions formed by the two magnetic poles $N_1$, $N_2$ become similar to the brush fur-shaped portion of the developing agent formed by a single magnetic pole and having a density which is low at the center of the single magnetic pole. As a result, the conventional developing device having two magnetic poles $N_1$, $N_2$ shown in FIG. 3 does not contribute to improvement in the developing ability.

In the magnet roll developing device, it is preferable to divide the brush fur-like portion of the developing agent formed by the developing main magnetic pole portion into a number of brush fur-like portions and to cause these brush fur-like portions thus obtained to evenly set upon the surface to be developed for the purpose of developing a picture image having a high resolving power.

But, in the conventional magnet roll developing device, the number of the brush fur-like portions formed by the developing main magnetic pole portion is minutely changed owing to the distance between the doctor blade and the non-magnetic rotary sleeve, magnetic flux density at the developing main magnetic pole, diameter of the developing agent particle or the like within a limited range. It is impossible, therefore, to considerably increase the number of brush fur-like portions of the developing agent having a suitable strength. As a result, the picture image having an excellent resolving power can only be developed within a limited range.

Figure 4:
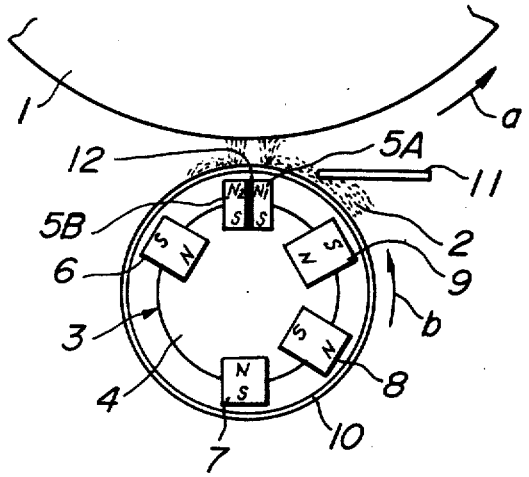
FIG. 4 is a diagrammatic view of one embodiment of a magnet roll developing device according to the invention.
Figure 5:
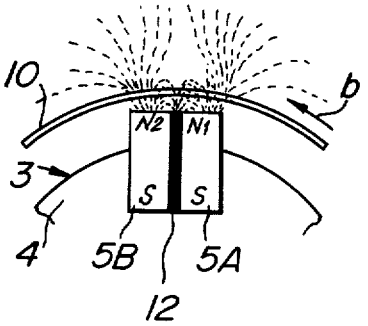
FIG. 5 is a diagrammatic view of a distribution condition of magnetic lines of force produced from a developing main magnetic pole of the developing device shown in FIG. 4.

FIG. 4 shows one embodiment of a magnet roll developing device according to the invention. The magnet roll developing device shown in FIG. 4 is different from the conventional magnet roll developing device shown in FIG. 1 with respect to the point that a developing main magnetic pole is composed of two magnet portions 5A, 5B having the same magnetic poles opposed to a surface to be developed 1 and distant apart from each other to form a space in which is arranged a magnetic body 12 such as an iron sheet or the like. In both FIGS. 1 and 4, the same members are designated by the same reference numerals. The above mentioned constructional feature that the magnet for forming the developing main magnetic pole is divided into two magnet portions so as to form a space therebetween, and that in the space is arranged a magnetic body 12 is capable of producing magnetic lines of force from the developing main magnetic pole as shown by dotted lines in FIG. 5.

That is, the magnetic lines of force produced from the magnet portions 5A, 5B near the center portion of the developing main magnetic pole are directed, through that portion of a magnetic circuit formed by the magnetic body arranged in the space which is the nearest to the magnet surface, toward the magnetic body 12. Those magnetic lines of force produced from the magnet portion 5A, 5B which are distant apart from the center portion of the developing main magnetic pole suddenly pass through that portion of the magnetic circuit which is far away from the magnet surface and are directed outwardly without passing through the magnetic body 12. The magnetic lines of force produced at those portions of the magnet portions 5A, 5B which are far away from the center portion of the developing main magnetic pole undergo an influence of the magnetic body 12 and trace loci which are similar to those taken by the magnetic lines of force produced from a conventional single magnetic pole. As a result, the density of the magnetic lines of force becomes high at that portion of the center part of the developing main magnetic pole which is very near the magnet surface and through which pass the magnetic lines of force and at that portion of outside the developing main magnetic pole from which are directed upwardly the magnetic lines of force, whereas the density of the magnetic lines of force becomes extremely low at that portion of the center part of the developing main magnetic pole which is more or less distant part from the magnet surface.

If the magnetic developing agent is introduced onto the field of the magnetic lines of force which are different in density as above described, the magnetic developing agent is substantially aligned in configuration which corresponds to that of the density of the magnetic lines of force. As a result, if the space between the non-magnetic rotary sleeve 10 on the one hand and the surface to be developed 1 and doctor blade 11 on the other hand in the magnet roll developing device according to the invention is suitably adjusted, it is possible to form two independent brush fur-like portions 2A, 2A' at two separate portions of the developing man magnetic pole.

Figure 6:
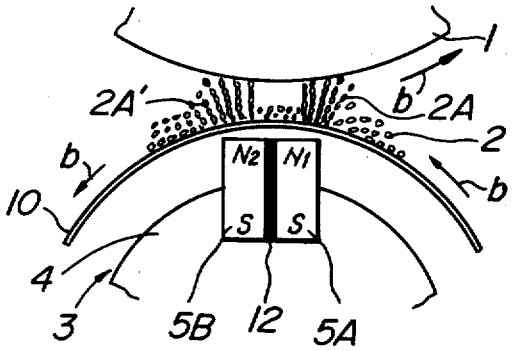
FIG. 6 is a diagrammatic view illustrating the developing action of the developing device shown in FIG. 4.

The developing operation of the present embodiment will now be described with reference to FIG. 6. If the non-magnetic rotary sleeve 10 is rotated in a direction b shown in FIG. 6, the magnetic pole $N_1$ of one of the magnet portions 5A causes the magnetic two component developing agent 2 riding on and moving with the non-magnetic rotary sleeve 10 to form a first brush fur-like portion 2A. If the developing agent 2 further advances to the center portion of the developing main magnetic pole, the magnetic lines of force is suddenly directed to the horizontal direction. As a result, that portion of the developing agent 2 which is adjacent to the bottom of the brush fur-like portion is suddenly directed to the horizontal direction aligned with the magnetic lines of force.

At the same time, the upper end of the brush fur-like portion of the developing agent 2 becomes fallen downwardly and scattered into the space where the density of the magnetic lines of force is small and agitated. The developing agent 2 thus scattered is transferred to that part of the magnetic lines of force which is produced by the magnetic pole $N_2$ of the other magnet portion 5B and which is high in density and formed into a second brush fur-like portion 2A' of the developing agent 2. The developing agent 2 for forming the second brush fur-like portion 2A' thereof is formed by a mixture of the developing agent belonging to the first brush fur-like portion 2A and making contact with the surface to be developed 1 and of the developing agent belonging to the first brush fur-like portion 2A but not making contact with the surface to be developed 1. But, the rate of the developing agent belonging to the brush fur-like portion thereof and making contact with the surface to be developed 1 is extremely small if compared with the developing agent belonging to the brush fur-like portion thereof but not making contact with the surface to be developed 1, and as a result, the developing agent 2 for forming the second brush fur-like portion 2A' thereof has a developing ability which is substantially the same as that of the first brush fur-like portion 2A of the developing agent 2.

As stated hereinbefore, the magnet roll developing device according to the present embodiment has a developing ability which is two times higher than that of the conventional magnet roll developing device. Since such improvement in the developing ability is attained without accelerating the moving speed of the developing agent 2, the scattering of the toner and carrier is not increased, and as a result, contamination of the surface to be developed 1 and overdevelopment of the non-picture image portion are not increased and it is possible to effectively prevent occurrence of uneven concentration in the moving direction of the developing agent. In addition, the surface to be developed 1 is subjected to the developing action twice times at two independent positions of the developing main magnetic pole by the brush fur-like portions 2A, 2A' having substantially the same order of developing abilities. In addition, the number of the brush fur-like portions is two times larger than that of the conventional brush fur-like portion, so that the development can be effected in a uniform manner and a picture image having an extremely high resolving power can effectively be developed.

Modified examples of a developing main magnetic pole of a magnet roll developing device according to the invention will now be described.

Figure 7:
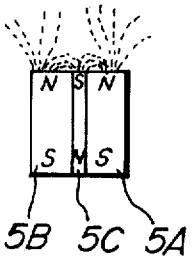
FIGS. 7, 8, 9 and 10 are diagrammatic views of different examples of a developing main magnetic pole of a magnet roll developing device according to the invention.

FIG. 7 shows another example of a developing main magnetic pole. In the present example, into a space formed between magnet portions 5A, 5B of the developing main magnetic pole is fitted a thin magnet 5C in place of the magnetic body composed of an iron sheet or the like shown in FIG. 4. The magnetic pole S of the thin magnet 5C which is opposite in polarity to magnetic poles N, N of the magnet portions 5A, 5B is exposed to the outside and the magnetic force of the thin magnet 5C is made weaker than those of the magnet portions 5A, 5B. This is because of the fact that of the magnetic force of the thin magnet 5C is made strong, the rate of the magnetic lines of force directed to the magnet 5C is so increased that the magnetic lines of force directed upwardly from the surface of the magnet portion 5A, 5B become decreased, so that it is impossible to obtain a sufficiently much amount of brush fur-like portion of the developing agent.

Figure 8:
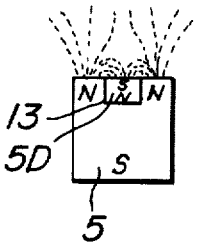

FIG. 8 shows a further example of a developing main magnetic pole. In the present example, the magnet 5 for the developing main magnetic pole is provided at its center portion with a groove 13 into which is fitted a small magnet 5D. Similar to the example shown in FIG. 7, the magnetic pole S of the small magnet 5D which is opposite in polarity to the magnetic pole N of the magnet 5 is exposed to the outside and the magnetic force of the small magnet 5D is made weaker than that of the magnet 5.

Figure 9:
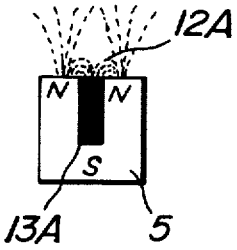

FIG. 9 shows a still further example of a developing main magnetic pole. In the present example, the magnet 5 for the developing main magnetic pole is provided at its center portion with a groove 13A having a depth which is deeper than that of the groove 13 shown in FIG. 8 and into the groove 13A is fitted a magnetic body 12A such as an iron sheet or the like. In FIGS. 7 to 9, dotted lines designate the distribution condition of the magnetic lines of force.

Figure 10:
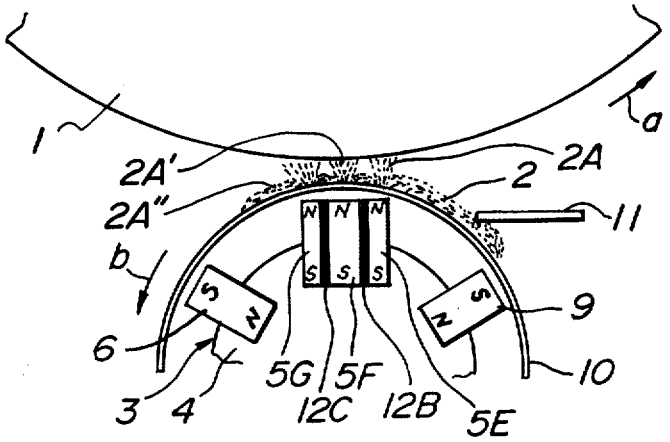

In addition, in order to effectively carry out the invention into effect, the developing main magnetic pole may be constructed such that the brush fur-like portions of the developing agent are formed at three or more than three independent portions of the developing main magnetic pole. FIG. 10 shows another example of a developing main magnetic pole. In the present example, in two spaces formed between magnets 5E, 5F, 5G for developing main magnetic pole and dividing it into three magnet portions are arranged magnetic bodies 12B, 12C such as iron sheets or the like so as to form three brush fur-like portions 2A, 2A', 2A" of the developing agent at the independent three portions, respectively. In FIG. 10, the same reference numerals as those already shown in the previous figures designate the same parts throughout the various views. In order to make these three brush fur-like portions 2A, 2A', 2A" of the developing agent uniform in shape, it is preferable to make the width of the magnet portion 5F at the center part of the developing main magnetic pole wider than those of the magnet portions 5E, 5G at both end portions thereof. Because, the width of the brush fur-like portion 2A' of the developing agent formed at the center part of the developing main magnetic pole becomes narrow by the action of the magnetic bodies 12B, 12C at the both side thereof. The use of measure of forming three brush fur-like portions 2A, 2A', 2A" having the same order of developing ability at independent three portions provides the important advantage that the developing ability of the device according to the invention is thrice that of the conventional device shown in FIG. 1.

As described above, if a developing magnetic pole is divided into a number of portions distant apart from each other to form spaces therebetween and a magnetic body or magnet is fitted therein so as to guide the magnetic lines of force into these spaces and form a number of brush fur-like portions of the developing agent, the developing operation becomes complete so much. But, these brush fur-like-portions of the developing agent do not contribute to the development unless the surface to be developed is effectively subjected to the action of the brush fur-like portions of the developing agent. As a result, the number of the brush fur-like portions of the developing agent in the region adjacent to the surface to be developed 1 is selected in any desired manner.

In the above described embodiment of a magnet roll developing device according to the invention, the magnet roll 3 is composed of the roll shaped supporting member 4 provided along its periphery with magnets magnetized beforehand. Alternatively, the magnet roll is composed of a roll-shaped supporting member 4A formed of a magnetic material and magnetized at its periphery so as to form magnetic poles as shown in FIG. 11A, 11B, 11C.

Figure 11A:
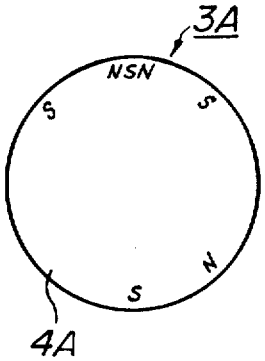
FIGS. 11A, 11B and 11C are diagrammatic views of three examples of a magnet roll of a magnet roll developing device according to the invention.

FIG. 11A shows another example of a magnet roll. In the present example, a magnet roll 3A is composed of a roll-shaped supporting member 4A having a developing main magnetic pole NSN consisting of two magnetic poles N, N and a weak and opposite magnetic pole S interposed therebetween.

Figure 11B:
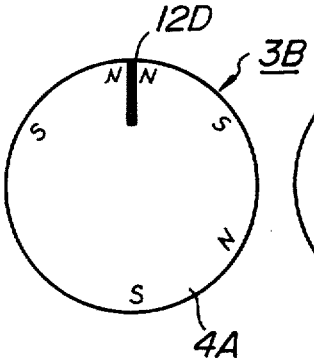

FIG. 11B shows a further example of a magnet roll. In the present example, a magnet roll 3B is composed of a roll-shaped supporting member 4A having a developing main magnetic pole consisting of two magnetic poles N, N and a groove interposed therebetween and having a magnetic body 12D embedded into the groove.

Figure 11C:
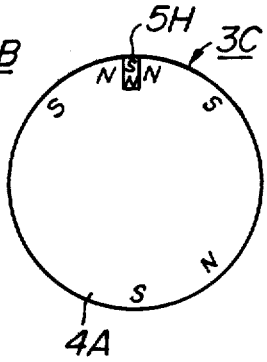

FIG. 11C shows a still further example of a magnet roll. In the present example, a magnetic roll 3C is composed of a roll-shaped supporting member 4A having a developing main magnetic pole consisting of two magnetic poles N, N and a groove interposed therebetween and having a small magnet 5H fitted in the groove.

Figure 12A:
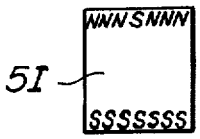
FIGS. 12A and 12B are diagrammatic views of another examples of a developing main magnetic pole and magnet roll of a magnet roll developing device according to the invention, respectively.

FIG. 12A shows a developing main magnetic pole composed of one magnet 5I which is provided at the center portion of the face opposed to the surface to be developed with a weak magnetic pole S which is opposite in polarity to the other side magnetic poles NNN and NNN.

Figure 12B:
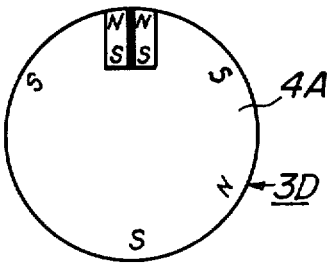

FIG. 12B shows another example of a magnet roll. In the present example, a magnet roll 3D is composed of a roll-shaped supporting member 4A formed of a magnetic material and provided along its periphery with a developing main magnetic pole and transfer magnetic poles formed by magnetization. The developing main magnetic pole is composed of any one of the magnets for the developing main pole shown in FIGS. 6 to 10 and FIG. 12A and fitted into a groove provided in the supporting member 4A.

As stated hereinbefore, in the magnet roll developing device according to the invention, the magnet for forming the developing main magnetic pole of the magnet roll is divided into a plurality of magnet portions distant apart from each other by spaces into which are arranged the magnetic bodies or weak magnets having opposite polarity. As a result, one part of the magnetic lines of force started from the developing main magnetic pole is directed toward the magnetic body or weak magnets arranged in the space so as to form the space located near the magnetic body or weak magnet and containing magnetic lines of force having a low density. This space produces independent brush fur-like portions of the developing agent each corresponding to each portion of the developing main magnetic pole divided by the spaces and having the same order of the developing ability, these brush fur-like portions of the developing agent being acted upon the surface to be developed. Thus, the magnet roll developing device according to the invention can effectively attain the above mentioned various objects of the invention. In addition, the use of measure of forming brush fur-like portions of the developing agent each having the same order of developing ability at the plurality of independent places of the magnet roll ensures the same effect as that obtained when use is made of a magnetic two component developing agent even when use is made of a magnetic one component developing agent or magnetic two component toner developing agent and provides the important advantage that the uneven development can be eliminated and that a picture image having a large resolving former can be obtained.

What is claimed is:

1. In a magnet roll developing device including a magnet roll composed of a roll-shaped supporting member made stationary with respect to a surface to be developed, said supporting member including a developing main magnetic pole opposed to the surface to be developed and a plurality of transfer magnetic poles, a non-magnetic rotary sleeve rotatably mounted around the outer peripheral surface of the magnet roll and a doctor blade for controlling a thickness of a developing agent layer held on the non-magnetic rotary sleeve, the improvement in which the developing main magnetic pole is divided into a plurality of magnet portions each having the same magnetic pole opposite the surface to be developed, said magnet portions spaced from each other to provide at least one space into which is arranged a spacing member composed of a magnetic body or magnet having a weak magnetic force in a direction such that the surface of said weak magnet is opposite in polarity to the poles of said magnet portions, a portion of the magnetic lines of force starting from the magnet surface of each of said magnet portions being directed toward said spacing member for forming an area in which magnetic lines of force are low in density near said spacing member, and the thickness of the developing agent layer held on said non-magnetic rotary sleeve being suitably adjusted to form at the magnet surface of each of said magnet portions an independent brush fur-like portion of the developing agent, each of said fur-like portions independently acting on the surface to be developed.

2. The device according to claim 1, wherein said magnet for forming the developing main magnetic pole is composed of a plurality of magnet portions spaced apart from each other by spaces into which are fitted spacing members and having magnetic poles directed in the same direction, said magnet roll further comprises a holding body for holding said magnet portions thereon.

3. The device according to claim 2, wherein said magnet for forming the developing main magnetic pole is provided at its end surface with a groove defined between adjacent magnet portions, said groove receiving a magnetic body or a magnet whose magnetic pole is opposite in polarity to the magnetic poles of said magnet portions and said magnet roll includes a holding body having said magnet for forming the developing main magnet pole held thereon.

4. The device according to claim 1, wherein said magnet for forming the developing main magnetic pole is composed of a magnetic body magnetized such that at least three magnetic poles are formed and that alternate magnetic poles are opposite in polarity and said magnetic roll further comprises holding means for holding said magnetic body.

5. The device according to claim 1, wherein said magnet roll is composed of a roll-shaped magnetic body which is magnetized so as to form a plurality of magnetic poles, one of these magnetic poles functioning as a developing main magnetic pole and the remaining magnetic poles functioning as transferring magnetic poles, said developing main magnetic pole being so magnetized that at least three magnetic poles that alternate in polarity are formed.

6. The device according to claim 1, wherein said magnet roll is composed of a roll-shaped magnetic body which is magnetized so as to form a plurality of magnetic poles, one of the magnetic poles constituting the developing main magnetic pole and the other magnetic poles constituting transferring magnetic poles, said developing main pole being provided with a groove into which is embedded a magnetic body.

7. The device according to claim 1, wherein said magnet roll is composed of a roll-shaped magnetic body which is magnetized so as to form a plurality of magnetic poles, one of these magnetic poles constituting a developing main magnetic pole and the other magnetic poles constituting transfer magnetic poles, said developing main pole being provided with a groove into which is embedded a magnet having an exposed magnetic pole surface which is opposite in polarity to that of the magnet portions of the developing main magnetic pole.

8. The device according to claim 1, wherein said plurality of magnet portions is two magnet portions and said at least one space is one space.

9. The device according to claim 1, wherein said plurality of magnet portions is greater than two magnet portions and said at least one space is greater than one space.

* * * * *